US007069919B1

(12) United States Patent
Atkinson et al.

(10) Patent No.: US 7,069,919 B1
(45) Date of Patent: Jul. 4, 2006

(54) METHOD AND APPARATUS FOR CONTROLLING THE RATIO OF AMBIENT AIR TO RECIRCULATED GASES IN AN INTERNAL COMBUSTION ENGINE

(75) Inventors: David C. Atkinson, Dunlap, IL (US); Yung Bui, Peoria, IL (US); Michael Evancik, Chillicothe, IL (US); Paul A. Gamble, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 11/030,471

(22) Filed: Jan. 6, 2005

(51) Int. Cl.
*F02B 47/08* (2006.01)

(52) U.S. Cl. ..... 123/568.19; 123/568.18

(58) Field of Classification Search ..... 123/568.19, 123/568.2, 568.24, 568.18
See application file for complete search history.

(56) References Cited

U.S. PATENT DOCUMENTS 3,070,345 A * 12/1962 Knecht ..... 251/212
4,153,024 A * 5/1979 Bertling ..... 123/588
4,366,799 A * 1/1983 Suda ..... 123/568.19
4,924,840 A 5/1990 Wade
5,213,087 A * 5/1993 Sausner et al. ..... 123/400
5,265,578 A * 11/1993 Zabeck et al. ..... 123/568.19
6,014,959 A * 1/2000 Ma ..... 123/568.19
6,039,034 A * 3/2000 Field et al. ..... 123/568.23
6,105,559 A 8/2000 Stoltman
6,571,782 B1 * 6/2003 Brosseau et al. ..... 123/568.18

* cited by examiner

*Primary Examiner*—Mahmoud Gimie
(74) *Attorney, Agent, or Firm*—Finnegan, Henderson, Farabow, Garrett & Dunner

(57) ABSTRACT

A method and apparatus for controlling the ratio of ambient air to recirculated gases in an internal combustion engine, wherein an gas injector includes a intake air conduit defining a ambient air flow path, an actuator connected to the intake air conduit, a recirculated gas conduit operatively coupled and disposed within the intake air conduit defining a recirculated gas flow path and a valve apparatus operatively coupled to the intake air conduit and recirculated gas conduit. The valve apparatus includes; a shaft, a throttle valve coupled to the shaft and in fluid communication with the ambient air flow and a recirculated gas valve coupled to the shaft in fluid communication with the recirculated gas flow. The shaft rotates one of the throttle valve and the recirculated gas valve independent of the rotation of the other one of throttle valve and said recirculated gas valve.

20 Claims, 5 Drawing Sheets

METHOD AND APPARATUS FOR CONTROLLING THE RATIO OF AMBIENT AIR TO RECIRCULATED GASES IN AN INTERNAL COMBUSTION ENGINE

TECHNICAL FIELD

This invention relates generally to controlling a ratio of ambient air to recirculated gas in an internal combustion engine, and, more particularly, to an apparatus having a throttle valve and recirculated gas valve controlled by a single actuator.

BACKGROUND

An internal combustion engine that utilizes a duct for transporting exhaust gas from the exhaust system into the intake system, known in the art as exhaust gas recirculation (EGR), generally has a means of controlling the ratio of ambient air to recirculated gas being introduced into the internal combustion engine.

Typically, a throttle valve is used to control the flow of ambient air and a recirculated gas valve is used to control the flow of recirculated gas, wherein the throttle valve and recirculated valve cooperate together to control the ratio of ambient air to recirculated air being introduced into the engine. Under predetermined conditions, the recirculated gas valve is opened to allow recirculated gas to enter the intake system. Under this condition, a first maximum ratio can occur. In order to get increase the ratio of ambient air to recirculated gas, the throttle valve can be closed. Under this condition, a second maximum ratio can occur and will be the maximum ratio having a higher ratio than the first maximum ratio.

It is well known in the art that two separate actuators operate and control the throttle valve and recirculated gas valve independently. This adds costs to the internal combustion engine and requires space for two actuators in an already space constrained internal combustion engine package. However, attempts have been made to try and reduce the cost through the use of a single actuator.

One known apparatus that uses a single actuator for controlling the ambient air to recirculated gas ratio is described in U.S. Pat. No. 6,105,559 issued to Stoltman on Aug. 22, 2000. Stoltman discloses an EGR port and an intake port adjacent to each other and a single rotatable shaft that extends across the two ports and supports an EGR throttle plate and air throttle plate. Because the EGR throttle plate and the throttle plate for fixed to the shaft they both rotate together. This does not allow for a first and a second maximum ratio to occur and the range to ratios is condensed by this action.

Another known apparatus that uses a single actuator for controlling the ambient air to recirculated gas ratio is described in U.S. Pat. No. 4,924,840 issued to Wade on May 15, 1990. Wade discloses an induction passage bifurcated to form an air induction passage and a EGR passage wherein the flow of air and EGR gases are controlled by a pair of butterfly type valves mounted on a common shaft. As would be inherent, and illustrated, the pair of butterfly type valves are separate and located in each one of the air induction passage and EGR passage. As with the same problems with Stoltman, the fixed butterfly valves to the shaft does not allow for a first and a second maximum ratio to occur.

The present disclosure is directed to overcoming one or more of the problems as set forth above.

SUMMARY OF THE INVENTION

A method of controlling the ratio of ambient air to recirculated gas in an internal combustion engine is disclosed. The method includes coupling a first and second valve rotatable between an open and closed position on a common shaft and rotating one of the first and second valves to any position between an open and closed position. In addition the method includes rotating the other one of the first and second valves to any position between the open and closed position independent of the rotation of the one of the first and second valves.

In an exemplary embodiment of the present invention a gas injector is disclosed. The gas injector includes an intake air conduit defining an ambient air flow path and a recirculated gas conduit defining a recirculated gas flow path, and the recirculated gas conduit is operatively coupled and disposed within said intake air conduit. In addition, the gas injector further includes an actuator connected to the intake air conduit. Further, the gas injector includes a valve apparatus operatively coupled to said intake air conduit and in fluid communication with the ambient air flow and recirculated gas flow. The valve apparatus includes; a shaft, a throttle valve coupled to the shaft and in fluid communication with the ambient air flow and a recirculated gas valve coupled to the shaft in fluid communication with the recirculated gas flow. The shaft rotates one of the throttle valve and the recirculated gas valve independent of the rotation of the other one of throttle valve and said recirculated gas valve.

DETAILED DESCRIPTION

Figure 1:
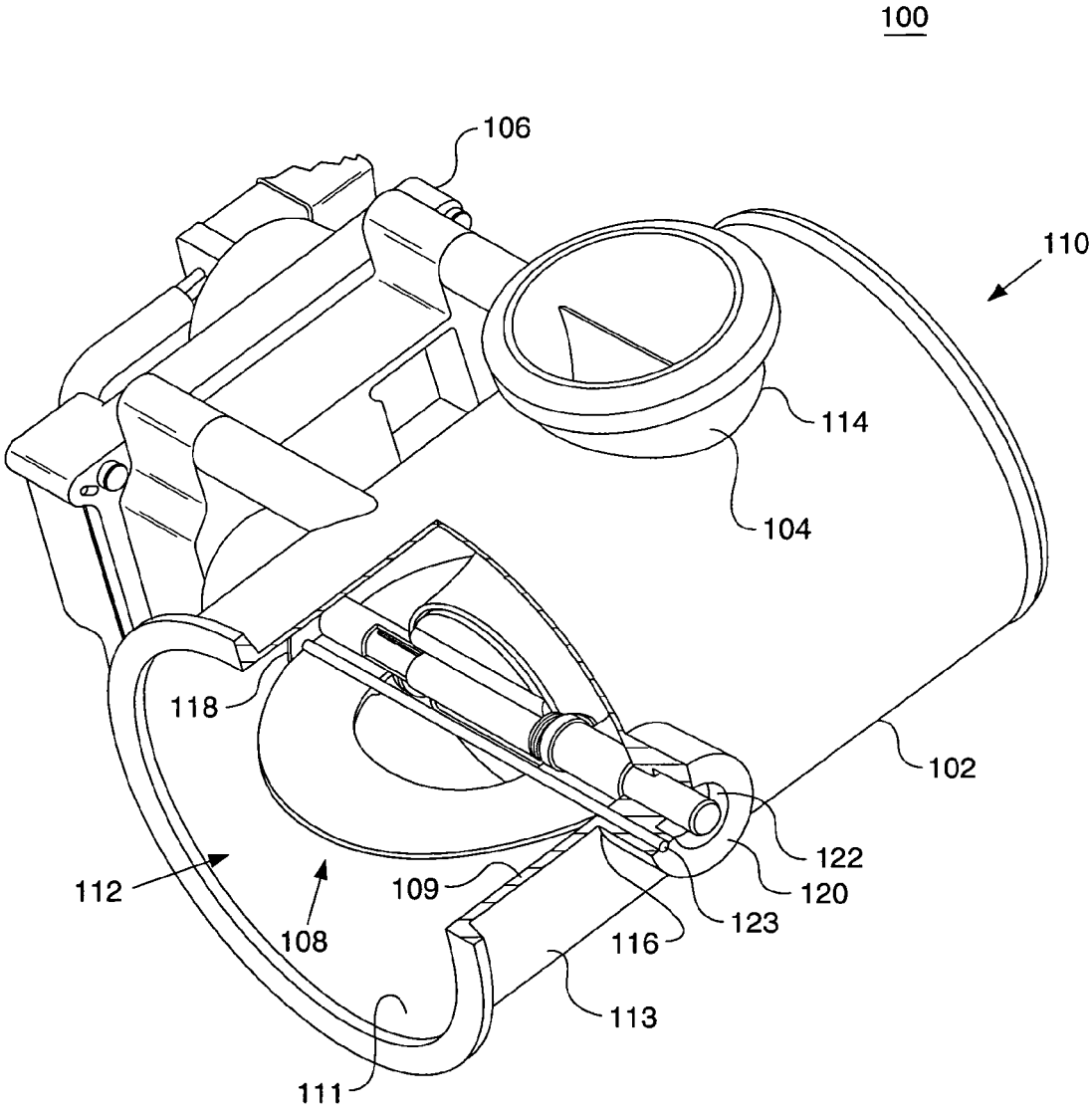
FIG. 1 is a perspective view of a gas injector incorporating a embodiment of the present invention.

Referring to the drawings, FIG. 1 shows an exemplary gas injector assembly 100 of an internal combustion engine (not shown), capable of controlling the ratio of ambient air to recirculated gases. For illustration purposes, the perspective view of the gas injector assembly 100 has a cut-away portion for viewing an embodiment of the present invention. The gas injector assembly 100 includes an intake air conduit 102, a recirculated gas conduit 104, an actuator 106 and a valve apparatus 108.

The actuator 106 shown is that of an electrical mechanical type, however, it should be understood that a mechanical, electrical, hydraulic, pneumatic, or any suitable type may be used with the embodiment of the present invention.

The exemplary intake air conduit 102 is structured to include an outer wall 109 having an inner surface 111 and an outer surface 113. The intake air conduit 102 may include an inlet 110 and an outlet 112 for fluid communication with an intake system (not shown) of the internal combustion engine (not shown).

The intake air conduit 102 may include a first aperture 114 extending through the outer wall 109 at an intermediate portion of the intake air conduit 102. The first aperture 114 is positioned and dimensioned to receive the recirculated gas conduit 104. The intake air conduit 102 may also include a second aperture 116 and a third aperture 118 extending through the outer wall 109 at the intermediate portion of the intake air conduit 102. The second aperture 116 and third aperture 118 are positioned as to be on opposing sides of the intake air conduit 102.

The intake air conduit 102 may include a first boss 120 connected to the intake air conduit 102 extending outwardly from the outer wall 109 of the intake air conduit 102 and aligning with the second aperture 116. The first boss 120 may include a fourth aperture 122 and fifth aperture 123 extending from one side of the first boss 120. The fourth aperture 122 and fifth aperture 123 are disposed adjacent from each other and may have different diameters.

Figure 2:
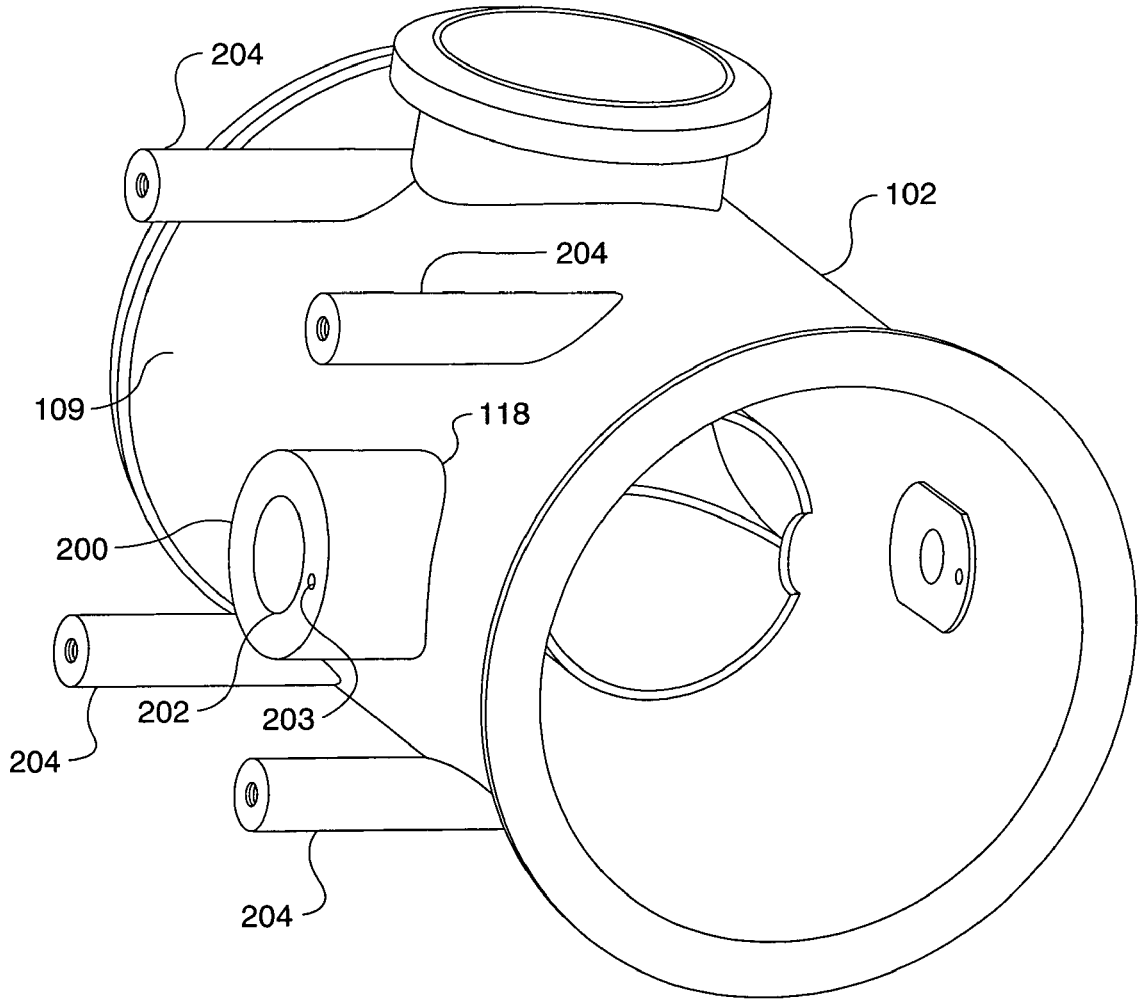
FIG. 2 is a perspective view of a intake air conduit.

Referring to FIG. 2, the intake air conduit 102 may include a second boss 200 extending outwardly from the outer wall 109 of the intake air conduit 102 and aligning with the third aperture 118. The second boss 200 may include a sixth aperture 202 and seventh aperture 203 extending from one side of the second boss 200. The sixth aperture 202 and seventh aperture 203 are disposed adjacent from each other and may have different diameters. In addition, the intake air conduit 102 may include a plurality of bosses 204 extending from the outer wall 109 of the charge air conduit 102 to connect the actuator 106 (shown in FIG. 1) to the intake air conduit 102.

Figure 3:
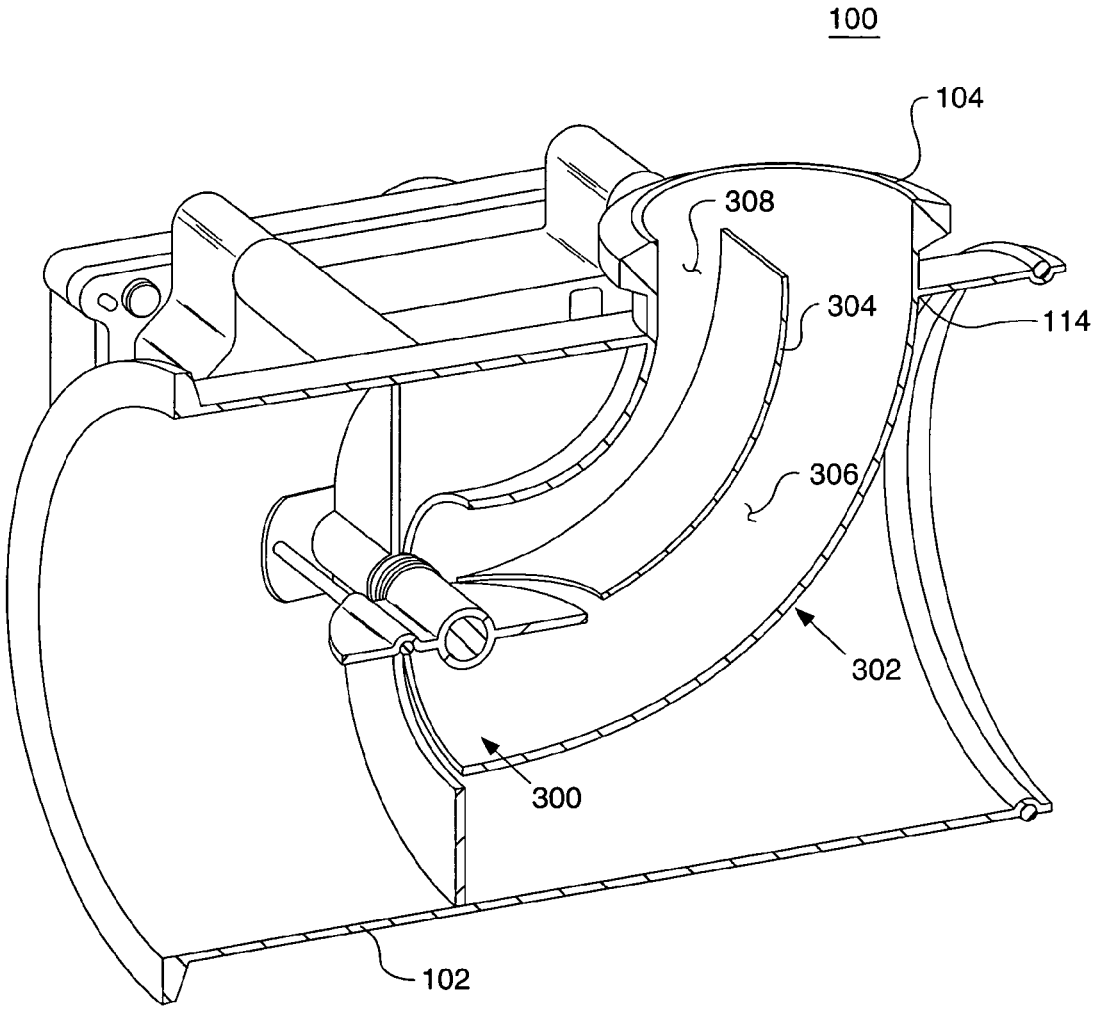
FIG. 3 is a perspective view of a cross-section of the gas injector.

Referring to FIG. 3, which shows a cross-section of the exemplary gas injector assembly 100, the exemplary recirculated gas conduit 104 is structured and arranged to intersect the intake air conduit 102 at the first aperture 114. The recirculated gas conduit 104 has a smaller diameter than the intake air conduit 102 diameter and includes an open end 300 for expelling recirculated gases into the charge air conduit 102. The intake conduit 104 includes a bent portion 302 for expelling the recirculated gas out of the open end 300. The bent portion 302 may include a turning vane 304, structured and arranged to divide the clean and cooled gas flow into a first flow path 306 and a second flow path 308.

Figure 4:
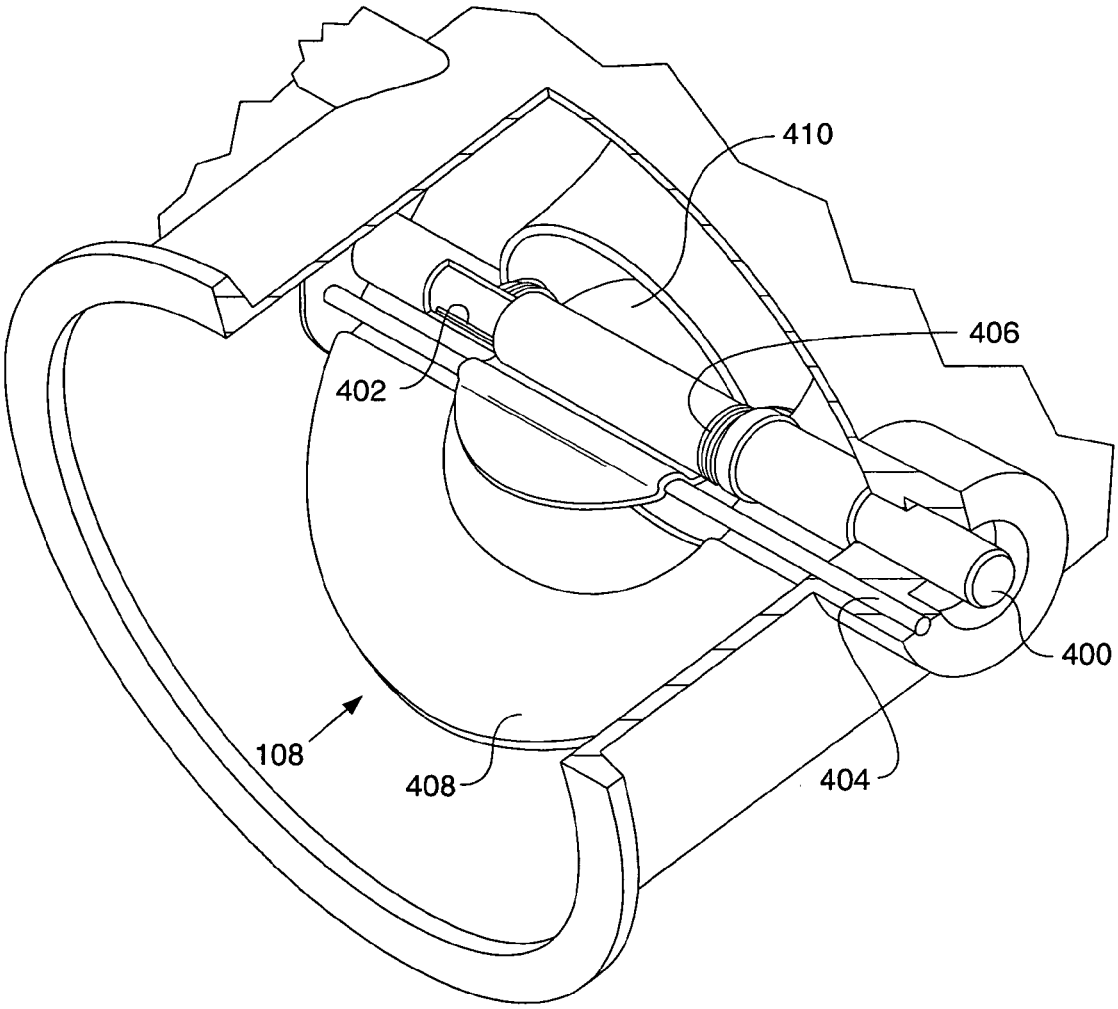
FIG. 4 is a perspective view of a valve apparatus incorporating an embodiment of the present invention.

Referring to FIG. 4 the valve apparatus 108 shown includes a shaft 400, a pick-up member 402, a stop 404, a biasing member 406, a throttle valve 408 and a recirculated gas valve 410. In the embodiment shown, the pick-up member 402 is operatively coupled to the shaft 400 at an intermediate portion of the shaft 400. This arrangement is typical of a key and keyway design, however, it should be understood that the arrangement could be setscrews, a boss, or the like.

Figure 4A:
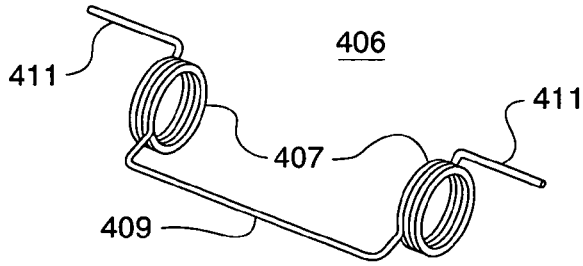
FIG. 4A is a perspective view of a torsion spring.

The biasing member 406 in the embodiment, shown in greater detail in FIG. 4*a*, is that of a typical torsion spring having two coils 407 on opposite ends of a connecting rod 409 and a pair of rods 411 extending outward from the each coil 407 at a predetermined length. It should be understood, however, that one coil with a rod extending inward and outward may be used with the embodiment of the present invention.

Figure 5:
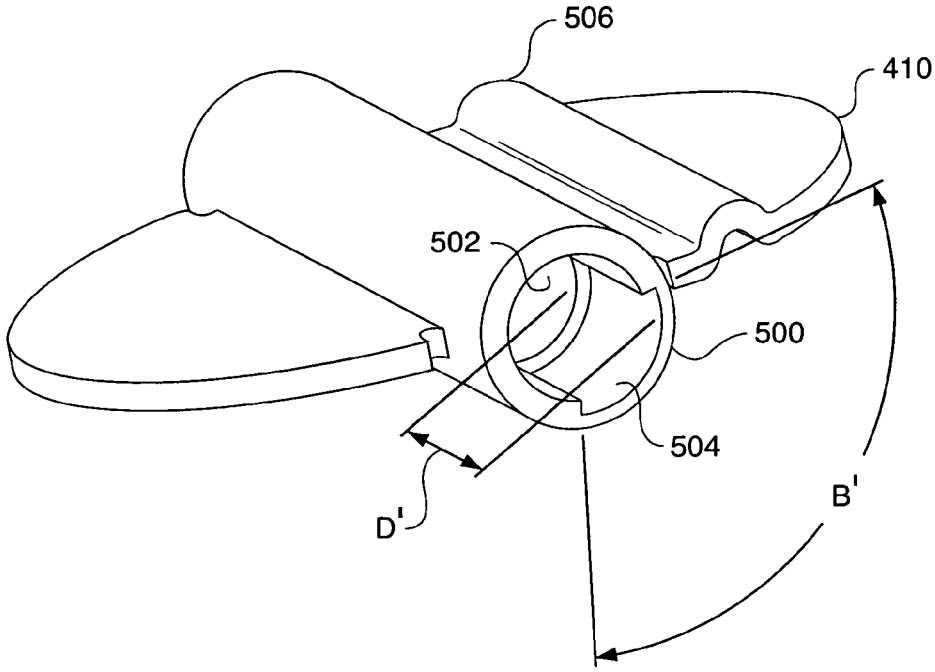
FIG. 5 is a perspective view of a recirculated gas valve.
Figure 6:
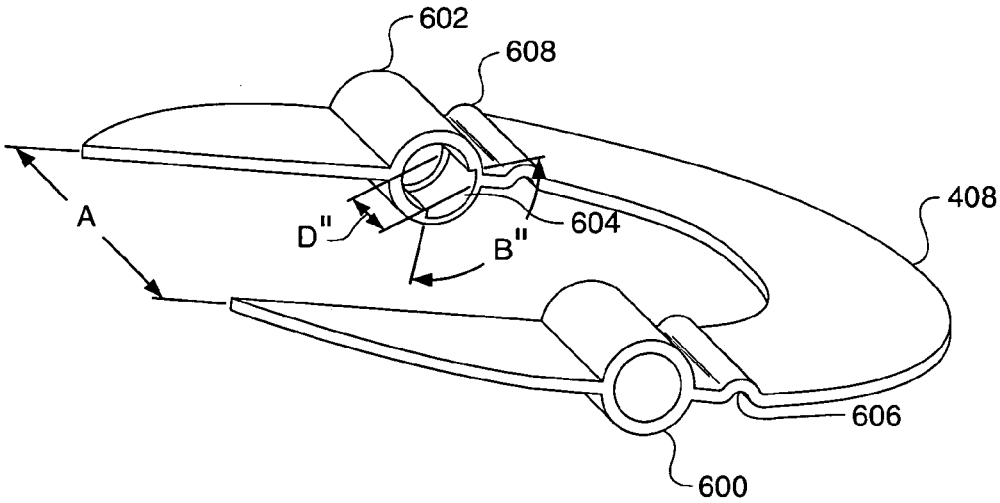
FIG. 6 is a perspective view of a throttle valve.

The recirculated gas valve 410 and throttle valve 408 will be shown in detail in FIGS. 5 and 6, respectively. The recirculated gas valve 410, shown in FIG. 5, is that of a typical butterfly type, however the structure of the recirculated gas valve 410 is at least dependent upon the structure of the open end 300 of the recirculated gas conduit 104, in as much as when the recirculated gas valve 410 is in its closed position it substantially seals the open end 300 of the recirculated gas conduit 104.

The recirculated gas valve 410 may include a first shaft-receiving conduit 500. In the embodiment shown the first shaft-receiving conduit 500 is of a cylindrical shape having a through hole 502 for receiving the shaft 400 (FIG. 4). The first shaft-receiving conduit 500 may include a first slot 504 extending from one end and along the inside diameter of the first shaft-receiving conduit 500. The first slot 504 is structured and arranged as to have a predetermined depth "D'" that extends around the inner circumference of the first shaft-receiving conduit 500 at a predetermined angle β'. In addition, the recirculated gas valve 410 may include a first stop recess 506 extending across the recirculated gas valve 410.

FIG. 6 shows the throttle valve 408 and is that of a typical butterfly valve, however the structure of the throttle valve 408 is at least dependent upon the structure of the inner surface 111 of the charge air conduit 102 (FIG. 1). The throttle valve 408 having a substantially "U" shape wherein the opening "A" is a predetermined width substantially greater than the diameter of the recirculated gas valve 410. The throttle valve 408 may include a second shaft-receiving conduit 600 and third shaft-receiving conduit 602. The third shaft-receiving conduit 602 may include a second slot 604 extending from one end and along the inside diameter of the third shaft-receiving conduit 602. The second slot 604 is structured and arranged as to have a predetermined depth "D'" that extends around the inner circumference of the third shaft-receiving conduit 602 at a predetermined angle β". It should be understood, however, the second shaft-receiving conduit 600 may include the second slot 604 and it is only exemplary that the second slot 604 is shown with the third shaft-receiving conduit 602. Herein, the second slot 604 will be used with the third shaft-receiving conduit 602, but it is understood that the second slot 604 may be used with the second shaft-receiving conduit 600. In addition, the throttle valve 408 may include a second stop recess 606 and a third stop recess 608 extending across the throttle valve 408.

Referring back to FIG. 4, the valve apparatus 108 is positioned within the charge air conduit 102 in as much as the valve apparatus 108 substantially seals the EGR conduit 104 in a closed position. The shaft 400 is operatively coupled to the actuator 106 and extends through the sixth aperture 202 (FIG. 2), the charge air conduit 102 and into the forth aperture 122.

The throttle valve 408 and EGR valve 410 are in a cooperating arrangement with the shaft 400, in as much as the first, second and third shaft-receiving conduits 500, 600, 602 axially align with the shaft 400. The pick-up member 402 being operatively coupled to the shaft 400 is operatively coupled to the throttle valve 408 and EGR valve 410, in as much as the pick-up member 402 is operatively connectable to the first and second slots 504, 604.

The biasing member 406 is a cooperating arrangement with the shaft 400, in as much as the shaft 400 supports the biasing member 406. The throttle valve 408 and the EGR valve 410 are operatively connected to the biasing member 406, in as much as the connecting rod 409 of the two coils 407 is operatively connected to the EGR valve 410 and the pair of rods 411 extending outward from the coils are operatively connected to the throttle valve 408.

The stop 404 aligns with the fifth and seventh aperture 123, 203 of the first and second bosses 120, 200, respectfully, and may protrude into the fifth and seventh aperture 123, 203, therefore, supporting the stop 404. The stop 404 may be arranged as to contact the throttle valve 408 and EGR valve 410, in particular the first, second and third stop recess 506, 606, 608, at a predetermined position of the throttle valve 408 and EGR valve 410.

INDUSTRIAL APPLICABILITY

Under predetermined operating conditions of an internal combustion engine it may be desired to introduce recirculated gases into the intake system (not shown). A gas injector assembly 100 is structured and arranged to introduce the recirculated gases into the intake system. A valve apparatus 108 of the gas injector assembly 100 is structured and arranged to vary the ratio of ambient air to recirculated gases with the use of a single actuator 106.

In an initial state the recirculated gas valve 410 of the valve apparatus 108 may be in a closed position, substantially sealing the recirculated gas conduit 104 and allowing a minimal amount of recirculated gases to enter the intake system. The recirculated gas valve 410 is held closed by the pick-up member 402 being operatively connectable to the recirculated gas valve 410, e.g., the pick-up member 402 may abut one side of the first slot 504. The biasing member 406 applies an opposing force to the abutment of the pick-up member 402 to the recirculated gas valve 410, thus holding the recirculated gas valve 410 in the closed position.

Also in the initial state, the throttle valve 408 may be in an open position, allowing the maximum amount of ambient air to flow through the charge air conduit 102 and into the intake system. The throttle valve 408 is held open by the stop 404 and the biasing member 406. Specifically, the throttle valve 408 abuts the stop 404 at the second and third stop recess 606, 608 and is held in the open position by the biasing member 406 applying an opposing force to the throttle valve's 408 abutment to the stop 404.

Upon the predetermined operating condition, when recirculated gases are to be introduced into the intake system, the recirculated gas valve 104 is opened. The actuator 106 being operatively coupled to the shaft 400 rotates the shaft 400 and inherently the pick-up member 402. The opposing force of the biasing member 406 maintains the abutment of the pick-up member 402 to the recirculated gas valve 410 during rotation of the shaft 400 and pick-up member 402. The first stop recess 506 of the recirculated gas valve 104 abuts the stop 404 upon the maximum open position of the recirculated gas valve 104, thus providing a first maximum ratio of ambient air to recirculated gases. The biasing member 406 applies an opposing force to the abutment of the recirculated gas valve 104 to the stop 404; holding the recirculated gas valve 104 in position.

To further decrease the ratio of ambient air to recirculated gases, the throttle valve 408 closes and chokes the ambient air flow through the inlet 110 of the intake air conduit 102. The recirculated gas valve 410 remains in the open position and the shaft 400 and pick-up member 402 continue to rotate within the first slot 504 of the recirculated gas valve 410 and the second slot 604 of the throttle valve 408. When the pick-up member 402 abuts the throttle valve 408, e.g., the pick-up member 402 abuts one side of the second slot 604, the throttle valve 408 begins to rotate and choke the ambient air. The throttle valve 408 is at its closed position when the shaft 400 and pick-up member 402 rotate the throttle valve 408 to a predetermined position, therefore, allowing the minimum amount of ambient air into the intake system. Upon the throttle valve 408 being in the closed position and the recirculated gas valve 410 being in the open position, the second maximum ratio of ambient air to recirculated gases is provided.

To increase the ratio of the ambient air to recirculated gas when the throttle valve 408 is a choke position and the recirculated gas valve 410 is in an open position, the actuator 106 rotates the shaft 400 and pick-up member 402. The opposing force of the biasing member 406 maintains the abutment of the pick-up member 402 to the throttle valve 408 during rotation of the shaft 400 and pick-up member 402. The second and third stop recess 606, 608 abuts the stop 404 upon the maximum open position of the throttle valve 104, thus providing the first maximum ratio of ambient air to recirculated gases. Upon continuing to rotate the shaft 400 and pick-up member 402, the pick-up member 402 rotates within the second slot 604 of the throttle valve 408 and the first slot 504 of the recirculated gas valve 410. The biasing member 406 holds the throttle valve 408 in position. When the pick-up member 402 abuts the recirculated gas valve 410, the recirculated gas valve 410 begins to rotate and close. The biasing member 406 maintains the abutment of the pick-up member 402 to the recirculated gas valve 410 during rotation of the shaft 400 and pick-up member 402. The recirculated gas valve 410 is rotated until it in a closed position.

Other aspects of the present invention may be obtained from study of the drawings, the disclosure, and the appended claims. It is intended that that the specification and examples be considered exemplary only.

What is claimed is:

1. A method of controlling the ratio of ambient air to recirculated gas in an internal combustion engine, comprising:

coupling a first and second valve rotatable between an open and closed position on a common shaft;

rotating one of the first and second valves to any position between an open and closed position; and rotating the other one of the first and second valves to any position between an open and closed position independent of the rotation of the one of the first and second valves.

2. The method of claim 1, wherein rotating one of the first and second valves includes actuating an actuator coupled to the common shaft.

3. The method of claim 1, wherein rotating one of the first and second valves includes stopping one of the first and second valves to reach a first maximum ratio of ambient air to recirculated gas.

4. The method of claim 3, further including stopping one of the first and second valves to reach a second maximum ratio of ambient air to recirculated gas.

5. A gas injector, comprising:

an intake air conduit defining an ambient air flow path;

a recirculated gas conduit defining a recirculated gas flow path, the recirculated gas conduit operatively coupled and disposed within said intake air conduit;

an actuator connected to the intake air conduit; and a valve apparatus operatively coupled to said intake air conduit and in fluid communication with the ambient air flow and recirculated gas flow, the valve apparatus includes: a shaft, a throttle valve coupled to the shaft and in fluid communication with the ambient air flow, and a recirculated gas valve coupled to the shaft in fluid communication with the recirculated gas flow, the shaft rotates one of the throttle valve and the recirculated gas valve independent of the rotation of the other one of throttle valve and said recirculated gas valve.

6. The gas injector of claim 5, wherein the actuator is an electro-mechanical type.

7. The gas injector of claim 5, wherein the valve apparatus includes a stop to hold one of the throttle valve and recirculated gas valve in a substantially fixed position.

8. The gas injector of claim 7, wherein the valve apparatus includes a biasing member coupled to the shaft.

9. The gas injector of claim 8, wherein the biasing member cooperates with the stop to hold one of the throttle valve and recirculated gas valve in the substantially fixed position.

10. The gas injector of claim 8, wherein the biasing member assists in the rotation of one of the throttle valve and the recirculated gas valve.

11. The gas injector of claim 5, wherein one of the throttle valve and the recirculated gas valve is a butterfly valve.

12. A method of controlling the ratio of ambient air to recirculated gas in an internal combustion engine, comprising:

coupling a throttle valve element and a recirculated gas valve element rotatable between an open and closed position on a common shaft;

rotating the throttle valve to the open and closed positions while the recirculated gas valve remains in the open position; and rotating the recirculated gas valve to the open and closed positions while the throttle valve remains in the open position.

13. The method of claim 12, wherein rotating the throttle valve includes actuating an actuator coupled to an end of the common shaft.

14. The method of claim 12, wherein rotating the throttle valve includes stopping the throttle valve to reach a maximum ratio of ambient air to recirculated gas.

15. The method of claim 14, wherein the maximum ratio is reached when the throttle valve and the recirculated gas valve are one of substantially coplanar or substantially perpendicular.

16. A gas injector, comprising:

an intake air conduit defining an ambient air flow path;

a recirculated gas conduit defining a recirculated gas flow path, the recirculated gas conduit operatively coupled and disposed within said intake air conduit;

an actuator connected to the intake air conduit; and a valve apparatus operatively coupled to said intake air conduit and in fluid communication with the ambient air flow and recirculated gas flow, the valve apparatus includes:

a shaft, a throttle valve element coupled to the shaft and in fluid communication with the ambient air flow, and a recirculated gas valve element coupled to the shaft and extending at least partially within a cavity defined by the throttle valve element, wherein the shaft rotates one of the throttle valve and the recirculated gas valve independent of the rotation of the other one of throttle valve and said recirculated gas valve.

17. The gas injector of claim 16, wherein one of the throttle valve and the recirculated gas valve is a butterfly valve.

18. The gas injector of claim 16, wherein the recirculated gas valve includes a first conduit configured to receive the shaft.

19. The gas injector of claim 18, wherein the throttle valve includes second and third conduits configured to receive the shaft.

20. The gas injector of claim 19, wherein the first conduit extends between the second and third conduits.

* * * * *